United States Patent [19]

Erickson

[11] 4,342,813

[45] Aug. 3, 1982

[54] METHOD FOR THE PRODUCTION OF A FUSED NONWOVEN FABRIC

[75] Inventor: Wayne K. Erickson, Seneca, S.C.

[73] Assignee: Phillips Petroleum Company, Bartlesville, Okla.

[21] Appl. No.: 886,484

[22] Filed: Mar. 14, 1978

[51] Int. Cl.[3] ..... D04H 1/04

[52] U.S. Cl. ..... 428/296; 428/288; 264/25; 264/126; 264/113

[58] Field of Search ..... 264/22, 25, 113, 126; 428/288, 296

[56] References Cited

U.S. PATENT DOCUMENTS

| | | | |
|---|---|---|---|
| 3,452,128 | 6/1969 | Rains | 264/126 |
| 3,576,687 | 4/1971 | Parlin | 156/148 |
| 3,607,999 | 9/1971 | Corbet et al. | 264/126 |
| 3,660,555 | 5/1972 | Rains et al. | 264/126 |
| 4,042,655 | 8/1977 | Platt et al. | 264/25 |

*Primary Examiner*—James R. Hall

[57] ABSTRACT

A fused nonwoven fabric of thermoplastic fibers having a first surface and a second surface opposite the first surface is produced by exposing at least one of the first and second surfaces of the fabric to infrared radiation and contacting at least one of the first and second surfaces of the fabric with at least one heated roll having a temperature sufficient to fuse together the fibers of the surface in contact with the heated roll.

14 Claims, 2 Drawing Figures

METHOD FOR THE PRODUCTION OF A FUSED NONWOVEN FABRIC

BACKGROUND OF THE INVENTION

The invention relates to a nonwoven fabric, method and apparatus for producing the nonwoven fabric.

In the last twenty-five years or so the development of polymeric materials has seen a tremendous growth. Polymeric materials lend themselves to a vast number of uses and applications. One of the more significant areas in which polymeric materials have been used is in the textile industry. The melt spinning of thermoplastic synthetic materials to produce continuous filaments, staple and yarns of such materials has revolutionized the textile industry.

Although much of the growth in the use of synthetic filaments has been in the use of knitted or woven fabrics, nonwoven materials of synthetic filaments also have experienced substantial growth. There are a number of methods known today for producing nonwoven fabrics from synthetic filaments and mixtures of natural and synthetic filaments. Nonwoven fabrics find a variety of uses. A specific area in which nonwoven fabrics have gained acceptance is in the manufacture of carpets. Since nonwoven fabrics made of synthetic fibers resist deterioration caused by mildew, synthetic nonwoven fabrics are used for the backing material in carpets and such carpets are excellent for use in areas exposed to moisture, such as patios and other outdoor areas.

Nonwoven fabrics are used in many other areas as well. For example, nonwoven fabrics both fused and unfused are used as substrates in the production of various laminates and as ticking material in the furniture industry. Although nonwovens are presently used in a variety of applications as indicated above, there is still a need to improve nonwoven fabrics especially with regard to their dimensional stability and strength.

Some of the nonwoven fabrics known in the art are those produced by needling fibers together employing at least one needle loom. The surface first penetrated by the needles of the needle loom is often referred to as the "face side" of the fabric and the "face side" of the fabric generally has a much smoother surface as compared to the opposite side of the fabric which is generally referred to as the "back side" of the fabric. As used herein the terms "face side" of the fabric and "back side" of the fabric are intended to refer to the respective surfaces described above.

In a number of applications it is desirable for a needle punched nonwoven fabric to have a substantial portion of the fibers forming the face side of the fabric fused together and to have a substantial portion of the fibers forming the back side of the fabric unfused so as to form a fuzzy or nap-like surface, frequently referred to as a beard. Also it is desirable to produce a nonwoven fabric with the face side essentially fused and the back side essentially unfused and having a "beard" which has a lower elongation and/or higher ultimate strength as compared to comparable prior art fabrics.

It is an object of the present invention to produce a nonwoven fabric.

Another object of the invention is to produce a fused nonwoven fabric with improved dimensional stability and strength as compared to fused nonwoven fabrics known in the art.

Another object of the present invention is to provide a fused nonwoven fabric produced from thermoplastic staple fibers having the fibers in the back side of the fabric substantially unfused to form a "beard" and having a higher ultimate strength and/or lower elongation in comparison to other comparable nonwoven fabrics known in the art.

Other objects, aspects and advantages of the invention will be apparent after studying the specification, drawing and the appended claims.

SUMMARY

According to the invention a fused nonwoven fabric of thermoplastic fibers having a first surface and a second surface opposite the first surface is produced by exposing at least one of the first and second surfaces of the fabric to infrared radiation to the extent that a substantial portion of the fibers of the at least one surface is fused together and contacting at least one of the first and second surfaces of the fabric with at least one heated roll having a temperature sufficient to fuse together at least a portion of the fibers of the surface in contact with the heated roll. In one aspect of applicant's invention a fused fabric of thermoplastic staple fibers is produced having a lower elongation and/or a higher ultimate strength, particularly when the back side of the fabric is unfused, as compared to comparable prior art nonwoven fabrics.

Further according to the invention apparatus is provided comprising, infrared fusion means being suitable for exposing the fibers of at least one surface of a nonwoven fabric having a first surface and a second surface opposite said first surface, and fusing together at least a portion of said fibers; and at least one heated roll being suitable for contacting at least one of said first and second surfaces of said fabric, and fusing together the fibers of the surface in contact with the heated roll.

BRIEF DESCRIPTION OF THE DRAWING

To further describe the invention the attached drawing is provided in which.

DETAILED DESCRIPTION OF THE INVENTION

Figure 1:
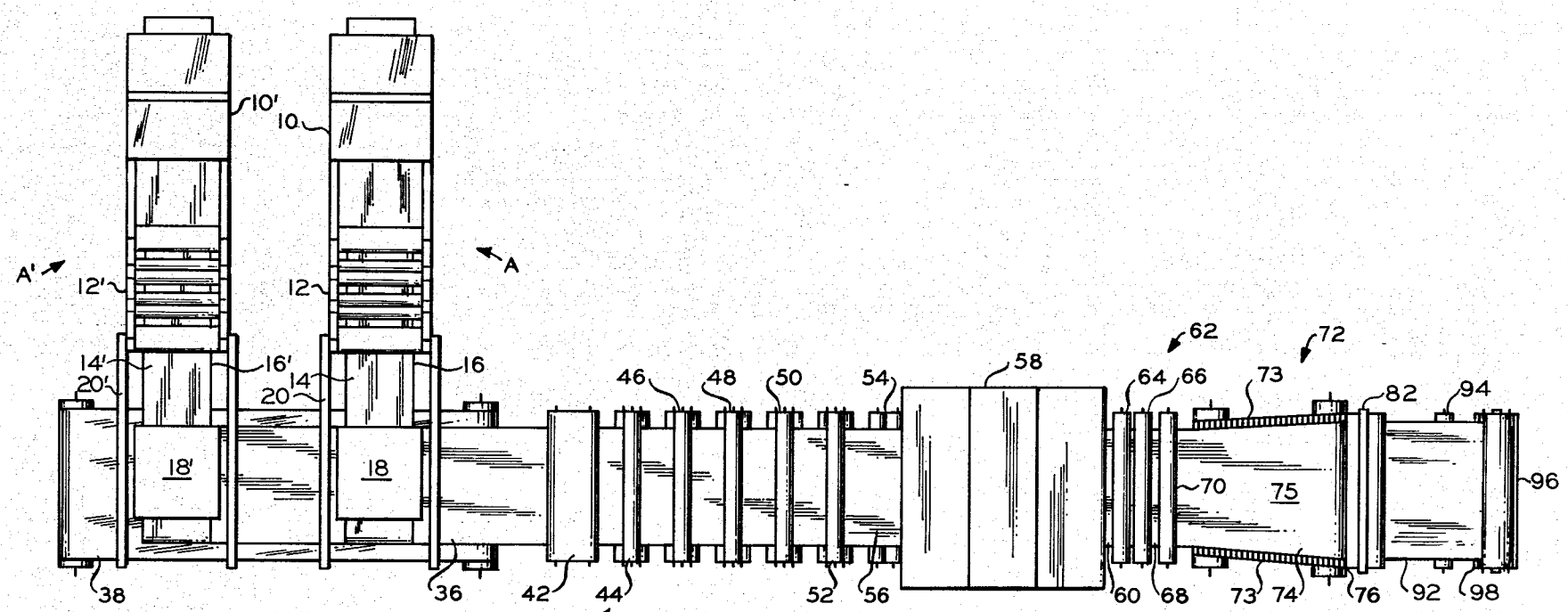
FIG. 1 is a top view of the schematic representation of an embodiment of the apparatus of the invention including apparatus suitable for producing an unfused nonwoven fabric.

The present invention is primarily based upon the discovery that an improved fused nonwoven fabric is produced when an unfused fabric is subjected to fusion temperatures employing infrared radiation and at least one heated roll. If the same unfused nonwoven fabric is fused by subjecting the fabric to fusion temperatures employing only infrared radiation or only at least one heat roll, then the fused fabric generally has a higher elongation and/or lower ultimate strength. Prior to the present invention it was known that roll fusion of a fabric primarily fused the surface of the fabric and that the fibers on or near the fused surface were flattened which destroyed the fibers' cross section and weakened the fibers. Also prior to the invention it was known that infrared radiation of a fabric not only fused the fibers on or near the surface exposed to the infrared radiation, but that infrared radiation fused fibers in the central portion of the fabric and even fibers on the surface opposite the surface exposed to the infrared radiation. It was known prior to the present invention that an infrared fused fabric generally had a lower elongation and/or a higher ultimate strength as compared to a comparable roll fused fabric. Thus it was surprising to discover that a fabric exposed to infrared radiation and roll fused generally has a lower elongation and/or higher ultimate strength as compared to a comparable infrared fused or roll fused fabric.

In a preferred embodiment of the invention staple fibers positioned on the back side of a fabric are substantially unfused and a substantial portion of the staple fibers positioned on the face side of the fabric and between the face side and the back side of the fabric are fused. In order to achieve a fabric described in the preferred embodiment, it was surprisingly found that the combination of infrared fusion and roll fusion in accordance with the present invention must be used in order to produce a fused fabric with the highest ultimate strength and/or the lowest elongation possible.

While it is not essential except in the preferred embodiment of the invention, it is generally desirable to expose the fabric to infrared radiation first and subsequently to contact the fabric with a heated roll. When the fabric is contacted with the heated roll, the fusion that takes place is essentially on the surface and the fibers on or near the surface are flattened so that when that surface is subsequently subjected to infrared radiation the flattened fibers tend to reduce penetration of the infrared radiation.

Nonwoven fabrics suitable for use in the invention can be almost any unfused nonwoven fabrics produced from the thermoplastic fibers. In the preferred embodiments of the invention the thermoplastic fibers are staple fibers and the nonwoven fabric is needle punched. Generally the nonwoven fabric employed has a weight within the range of about 2 oz/yd$^2$ to about 20 oz/yd$^2$; however, the weight of the fabric employed is more often within the range of about 2.5 oz/yd$^2$ to about 4.5 oz/yd$^2$.

Figure 2:
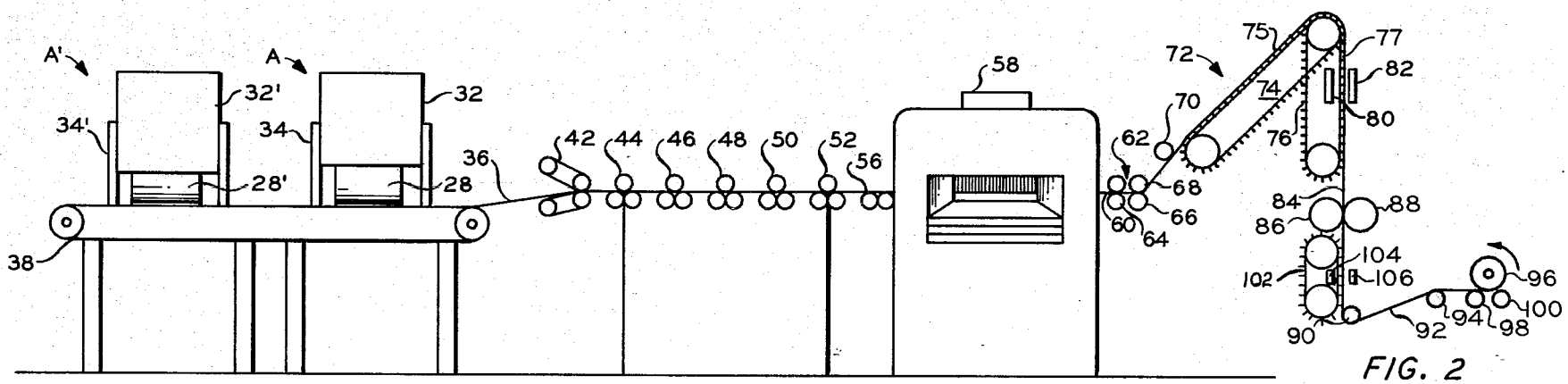
FIG. 2 is an elevational view of the apparatus of FIG. 1.

In order to more fully understand the present invention FIGS. 1 and 2 are provided which include apparatus in accordance with applicant's invention and apparatus for producing a nonwoven fabric suitable for use in the invention. Referring to FIGS. 1 and 2 a batt-forming means is shown comprising two web-forming trains A and A' in which feed means 10,10' such as bale breakers, blender boxes, feed boxes, etc., feed fibers in the form of staple, such as polypropylene staple, to carding machines 12,12'. The carding machines 12,12' produce carded webs 14,14' of fibers which are picked up by the takeoff aprons 16,16' of crosslappers 20,20'. Crosslappers 20,20' also comprise lapper aprons 18,18' which traverse a carrier means, such as floor apron 38, in a reciprocating motion laying the webs 14,14' to form a batt 36 on the floor apron 38.

The carded webs 14,14' are laid on floor apron 38 to build up several thicknesses to produce batt 36. The fibers forming batt 36 are oriented primarily in the fill direction, that is, a direction perpendicular or normal to the direction of movement of batt 36 positioned on floor apron 38. Two web-forming trains A and A' or more are used to increase the speed of the overall operation; however, one such web-forming train can be employed.

As used throughout the specification and claims, the term "fill direction" means the direction transverse to the direction of movement of batt 36 on floor apron 38. The term "warp direction" means the direction parallel to the direction of movement of batt 36 on floor apron 38.

A first drafting means 40, comprising at least two sets of nip rolls or an inlet apron 42 and one set of nip rolls 44, is used to draft batt 36. As used herein the terms stretching, drawing and drafting are synonymous. In FIGS. 1 and 2 the first drafting means comprises five sets of nip rolls 44, 46, 48, 50 and 52 and inlet apron 42 and outlet apron 54. Each set of nip rolls is shown as a one-over-two configuration, which works very well, but almost any arrangement can be used, such as a one-over-one, two-over-one, etc., as well as mixtures of nip roll configurations. The drafted batt 56 then is passed to needle loom 58 wherein the batt is needled at a density in the range of 100 to 1000 punches per square inch and at a needle penetration in the range of from about ¼ inch to about ¾ inch. One or more needle looms can be used. The needle looms can be either single needle board or a double needle board looms.

The drafted, needled batt 60 is again drafted in the warp direction by a second drafting means 62 comprising at least two sets of nip rolls 64 and 66 or an inlet apron and one set of nip rolls (not shown). The needled batt 68 which was drafted in the warp direction both before and after needling is passed under roll 70 to a third drafting means, such as tenter frame 72 which drafts needled batt 68 in the fill direction to produce batt 75. As shown clearly in FIG. 2, tenter frame 72 comprises a fill-drafting means 74 and a tensioning means 76. Tensioning means 76 is not used to draft batt 77, but to subject batt 77 to tension in the fill direction.

Infrared heating means 80 and 82 are shown on opposite sides of the unfused batt or fabric. Infrared heating means 82 is positioned to expose the face side of fabric 77 to infrared radiation sufficient to fuse together at least a portion of the fibers on the face side and infrared heating means 80 is positioned to expose the back side of fabric 77 to infrared radiation sufficient to fuse together at least a portion of the fibers on the back side. While only one infrared heating means is shown on each side of fabric 77 two or more infrared heating means can be employed on either or both sides of fabric 77 if desired.

Subsequent to tensioning means 76 are two rolls 86 and 88 wherein at least one of said rolls is heated to a temperature sufficient to fuse together a portion of the fibers of the surface of fabric 84. More than one heated roll can be employed for either or both sides of the fabric, if desired; however, it is generally sufficient to position one roll which can be heated to the desired temperature on the face side of fabric 84, such as roll 88, and one roll which can be heated to the desired temperature on the back side of fabric 84, such as roll 86.

In an optional embodiment of the apparatus of the invention a second tensioning means 102 and associated infrared fusion means 104 and 106 can be used in order to subject the fabric 84 to infrared radiation subsequent to fusion of the fibers of the fabric with heated rolls; however, it is emphasized that this additional equipment is optional and such equipment is only needed when it is desired to fuse the fabric with infrared radiation after the fabric is roll fused. When infrared fusion means 104 and 106 are employed, infrared fusion means 80 and 82 and tensioning section 76 generally are not required although tensioning means 76 is recommended in order to stabilize fabric 75 exiting drafting means 74.

The fabric 90 exiting rolls 86 and 88 and tensioning means 102, if fused, passes over idler rolls 90 and 94 and is rolled up over windup rolls 98 and 100, at least one of which is driven by a suitable power means (not shown) to produce a roll of fused fabric 96.

In the operation of the apparatus shown in FIGS. 1 and 2 synthetic thermoplastic fibers in the form of staple are passed from feed means 10,10' to carding machines 12,12' to produce carded webs 14,14'. The carded webs 14,14' are picked up by takeoff aprons 16,16' of cross-lappers 20,20'. Lapper aprons 18,18' lay the carded webs on floor apron 38 to produce batt 36. The number of webs used to form batt 36 depends upon a number of variables, such as the desired weight of the batt, the weight of the webs, the amount the batt is drafted during the process, etc. The batt 36 is then drafted in the warp direction by suitable means, such as the five sets of nip rolls 44, 46, 48, 50 and 52. When using nip rolls only two sets of nip rolls actually are required to draft the batt; however, the use of more than two sets of nip rolls, such as the five nip rolls shown, provides a more uniform drafting since between any set of nip rolls a smaller drafting ratio can be used and still obtain the overall desired drafting ratio. In addition, the batt is frequently drafted between the nip formed by the feed apron and the first set of nip rolls 44. The batt 36 is drafted because each set of nip rolls is operated at a successively higher speed than the speed of the preceding inlet apron or set of nip rolls. Generally it has been found that utilization of more sets of nip rolls and smaller draft ratios between each set of nip rolls produces a more uniform fabric than utilization of fewer sets of nip rolls with higher draft ratios; however, at some point additional sets of nip rolls with reduced draft ratios between each set of nip rolls will not improve the product. In addition, there is a maximum speed at which the batt at a given weight can be produced due to the limitations of the batt-forming equipment. Thus, as in almost any process, the most economical operation requires consideration of a number of variables, and in particular the various parameters of the material processed. For example, some of the variables of the processed material which affect the drafting process are staple polymer, staple length and denier, staple finish, degree of crimp, weight of the batt, etc. Generally from about 2 to about 6 sets of nip rolls are utilized with an overall draft ratio within a range of about 1.01 to about 4 and a maximum draft ratio between sets of nip rolls of 2. However, a very good product is produced utilizing from about 3 to 5 sets of nip rolls with an overall draft ratio within a range of about 1.2 to 1.8 and a maximum draft ratio between sets of nip rolls of 1.3.

The drafted batt 56 is then passed to needle loom 58 wherein the batt is needled to make a more coherent material. As stated above, one or more needle looms can be used and in addition each needle loom can be a double board needle loom. It is noted that the batt will experience some drafting as it passes through the needle loom which must be taken into consideration in determining the operating speeds of equipment positioned subsequent to the needle loom. It is not uncommon to experience drafting at a ratio in the range of from about 1.3 to about 2, employing one single board needle loom or one double board needle loom. The larger drafting ratios in the above range are normally experienced using a double needle board loom.

The drafted, needle batt is again drafted in the warp direction in a second drafting means 62, such as employing nip rolls 64 and 66, and operating the speed of nip rolls 66 at a slightly higher speed than nip rolls 64. The draft ratio employed in the second drafting zone is also selected depending upon the material processed. Generally the draft ratio in the second drafting zone is within a range of about 1.01 to about 2; however, a good product is produced utilizing a draft ratio within a range of about 1.3 to about 1.5.

Needled batt 68 which has been drafted in the warp direction both before and after needling is then passed to a third drafting zone, indicated by tenter frame 72 which drafts the batt in the fill direction through the use of diverging tracks 73 which grasp the fabric at the inlet and draft the fabric as the tracks slowly diverge from one another. The fill-drafting ratio depends upon a number of variables, such as staple length, denier, batt weight, needle density, etc. Generally the fill-drafting ratio is within a range of about 1.01 to about 1.5; however, a fill-drafting ratio within a range of about 1.1 to about 1.3 produces a good product. In one aspect of the invention tenter frame 72 contains a tensioning means 76 which applies tension to the fabric in at least the fill direction 78 while the fabric is fused when subjected to infrared radiation.

After the fabric 84 passes through tensioning means 76 fabric 84 is passed between the nip of two rolls 86 and 88 which are used to contact fabric 84 with at least one heated roll having a temperature sufficient to fuse together at least a portion of the fibers of the fabric in contact with the heated roll. The fused fabric then passes to the rollup section as previously described unless the second tensioning means 102 is employed also as previously described.

Synthetic thermoplastic staple in general can be used in accordance with the present invention. For example, polyolefins such as polypropylene, polyesters such as polyethylene terephthalate, polyamides such as polycaprolactam, and mixtures thereof are suitable. Particularly good results have been obtained employing polypropylene staple. When polypropylene fibers are used to produce the nonwoven fabric the temperature of the fusion roll or rolls employed is generally within a range of about 310° F. (154° C.) to about 340° F. (171° C.); however, temperatures within a range of about 320° F. (160° C.) to about 330° F. (165° C.) are more common.

The synthetic staple suitable for use in applicant's invention can be selected over a relatively wide range. Generally synthetic staple has a length within a range of about 1½ inches (3.81 cm) to about 10 inches (25.4 cm). Good results can be obtained employing a staple length within a range of about 2½ inches (6.35 cm) to about 4 inches (10.2 cm). Staple denier can be selected from a wide range of deniers. Normally the denier is within a range of about 1 to about 20; however, deniers within a range of about 1.5 to about 8 are more common.

Quartz heaters and foil-strip heaters have been used as the infrared radiation source in accordance with the present invention; however, the present invention is not limited by the particular source used to subject the fabric to the infrared radiation. At the present time it appears that the foil-strip heaters are preferred because they provide better control of the fusion process.

In general, fabrics with a variety of widths can be produced in accordance with the present invention; however, the invention is particularly applicable for the production of wide, nonwoven fabrics, that is, fabrics having a width within a range of about 108 inches (274.3 cm) to 230 inches (584.2 cm).

EXAMPLE

Five fused fabric samples were made using the apparatus of FIGS. 1 and 2 except that the optional tensioning means 102 and the associated infrared fusing means 104 and 106 were not employed. The samples produced in runs 1, 2 and 3 were control samples. The fabric of run 1 was fused using infrared radiation only and the fabrics of runs 2 and 3 were fused using roll fusion only. The fabrics of runs 4 and 5 were first fused with infrared radiation and subsequently fused with a heated roll in accordance with the present invention. All fabrics (runs 1 through 5) were produced with 4-denier polypropylene staple, 3¼ inches (8.25 cm) long and only the face side of the fabrics was exposed to infrared radiation and/or a heated roll in order to produce a fabric in which the fibers on the back side were substantially unfused. All fabrics weighed 3.1 oz/yd$^2$ and were produced under essentially the same conditions except for the fusion conditions. All fabrics were 150 inches (381 cm) wide except the fabric of run 2 which was 120 inches (304.8 cm) wide. The infrared heaters employed in runs 1, 4 and 5 were Leeco speed foil heaters, model 2-224-A, manufactured by Joyal Industries, Inc. Coventry, R.I. In runs 1, 4 and 5 the infrared heaters were stacked and positioned transverse with respect to the direction of movement of the fabric. The fusion conditions for each of the runs are provided in Table I below:

TABLE I

| Run No. | 1 | 2 | 3 | 4 | 5 |
|---|---|---|---|---|---|
| Fusion Roll Temperature, °F. | Not Used | 320 (159.8° C.) | 325 (162.6° C.) | 330 (165.4° C.) | 325 (162.6° C.) |
| Number of Infrared Heaters | 6 | Not Used | Not Used | 4 | 4 |
| Voltage applied to Infrared Heaters | 490 | — | — | 440 | 440 |

The physical properties of the fabrics produced are provided in Table II below.

TABLE II

| Run No. | Elongation(1) @10 lbs, in/3 in. | | Ultimate Strength (lbs)(2) | Tear Strength (lbs)(3) |
|---|---|---|---|---|
| 1* | Warp | 0.2 | 72 | 24 |
| | Fill | 0.4 | 81 | 28 |
| 2 | Warp | 0.5 | 62 | 25 |
| | Fill | 0.7 | 74 | 28 |
| 3 | Warp | 0.4 | 62 | 26 |
| | Fill | 0.3 | 71 | 30 |
| 4 | Warp | 0.4 | 68 | 27 |
| | Fill | 0.4 | 87 | 31 |
| 5 | Warp | 0.4 | 68 | 25 |
| | Fill | 0.3 | 92 | 30 |

(1)ASTM D 1117-74
(1)ASTM D-1117-74
(3)ASTM D 2263-75T
*The fabric produced in this run had a substantial portion of the fibers onthe back side of the fabric fused which reduced the fuzziness or nap on the back side of the fabric and the uniformity of the fabric had a somewhat inferior appearance and feel as compared to the other fabrics produced in the other runs.

As clearly indicated in Table II the ultimate strength of the fabric of runs 4 and 5 was higher as compared to the fabrics of runs 2 and 3. The ultimate strength of the fabric of run 1 was higher than the fabrics of runs 4 and 5 in the warp direction, but as noted above the fabric of run 1 did not have a substantially unfused back side. The fill ultimate strength of runs 4 and 5 is particularly noteworthy and is the highest in all instances. It is pointed out that the elongation values were not exactly the same in all runs; however, excpet for run 2, the elongation values are considered comparable. It is normally accepted that if elongation is lower, ultimate strength is lower, thus the ultimate strength of the fabric in run 2 would be even lower if the elongation values were lower. The tear strength values for the fabrics of runs 4 and 5 as compared to the fabrics of runs 1, 2 and 3 are somewhat improved, although the values for ultimate strength are generally considered more accurate for purposes of comparison.

The above runs clearly show that the fabrics of runs 4 and 5 which were produced in accordance with the present invention provide lower elongations and/or higher ultimate strengths as compared to the prior art fabrics produced in runs 1, 2 and 3.

What is claimed is:

1. A method for the manufacture of a fused nonwoven fabric from an unfused needle-punched nonwoven fabric of thermoplastic staple fibers, the unfused fabric having a first surface and a second surface opposite said first surface, comprising the steps of:

first exposing at least one of said first and second surfaces of the unfused fabric to infrared radiation to the extent that a substantial portion of the fibers forming said at least one surface and between said first surface and said second surface are fused together and the fibers forming the second surface remain substantially unfused; and subsequently contacting the thus-treated at least one surface of the nonwoven fabric with at least one heated roll having a temperature sufficient to fuse together at least a portion of the fibers forming the surface in contact with the heated roll.

2. The method of claim 1 in which the first surface is the face side of the unfused fabric, the second surface is the back side of the unfused fabric, and the face side is exposed to both infrared radiation and to the heated roll.

3. The method of claim 2 in which only the face side is exposed to infrared radiation and a heated roll.

4. The method of claim 3 in which the unfused fabric is a needle-punched nonwoven fabric of thermoplastic polypropylene staple fibers, the back side of the fabric has a fuzzy surface, and the fused fabric has high ultimate strength in comparison with elongation as determined by ASTM D 1117-74.

5. The method of claim 4 in which the weight of the unfused fabric is within the range of about 2 oz/yd$^2$ to about 20 oz/yd$^2$.

6. The method of claim 4 in which the weight of the unfused fabric is within the range of about 2.5 oz/yd$^2$ to about 4.5 oz/yd$^2$.

7. A nonwoven fabric produced by the method of claim 1.

8. A nonwoven fabric produced by the method of claim 3.

9. The method of claim 1 in which the unfused nonwoven fabric is produced by (a) forming a batt comprising thermoplastic staple fibers wherein the staple fibers are positioned primarily in a first direction;

(b) passing the batt to a first drafting zone;

(c) drafting the batt in the first drafting zone in a second direction, the second direction being primarily perpendicular to the first direction to produce a drafted batt;

(d) needling the drafted batt to produce a needled batt;

(e) drafting the needled batt in a second drafting zone in the second direction; and (f) then drafting the needled batt in a third drafting zone in the first direction to produce an unfused fabric.

10. The method of claim 9 in which the unfused fabric is produced from thermoplastic polypropylene staple fibers, the first surface is the face side of the unfused fabric, the second surface is the back side of the unfused fabric, and the face side is exposed to both infrared radiation and to the heated roll.

11. The method of claim 10 in which only the face side of the unfused fabric is exposed to infrared radiation and to the heated roll.

12. The method of claim 11 in which the fibers of the unfused fabric are subjected to tension in at least the first direction when the fibers of the unfused fabric are fused together by infrared radiation.

13. A nonwoven fabric produced by the method of claim 9.

14. A nonwoven fabric produced by the method of claim 11.

* * * * *